US006190854B1

(12) United States Patent
Sampei

(10) Patent No.: US 6,190,854 B1
(45) Date of Patent: Feb. 20, 2001

(54) THERMALLY DEVELOPABLE MATERIAL

(75) Inventor: Takeshi Sampei, Hino (JP)

(73) Assignee: Konica Corporation (JP)

( * ) Notice: Under 35 U.S.C. 154(b), the term of this patent shall be extended for 0 days.

(21) Appl. No.: 09/400,611

(22) Filed: Sep. 20, 1999

(30) Foreign Application Priority Data

Sep. 29, 1998 (JP) ..... 10-275240

(51) Int. Cl.[7] ..... G03C 1/498
(52) U.S. Cl. ..... 430/617; 430/619; 430/631
(58) Field of Search ..... 430/617, 619, 430/631

(56) References Cited

U.S. PATENT DOCUMENTS

| | | | | |
|---|---|---|---|---|
| 5,051,335 | * | 9/1991 | Kato | 430/203 |
| 5,532,121 | * | 7/1996 | Yonkoski et al. | 430/617 |
| 5,582,966 | * | 12/1996 | Nakamura et al. | 430/569 |
| 5,652,195 | * | 7/1997 | Horsten et al. | 430/226 |
| 5,710,095 | * | 1/1998 | Horsten et al. | 430/210 |
| 5,750,328 | * | 5/1998 | Melpolder et al. | 430/619 |

FOREIGN PATENT DOCUMENTS

| | | |
|---|---|---|
| 0803766 | 10/1997 | (EP) . |
| 0933672 | 8/1999 | (EP) . |

OTHER PUBLICATIONS

European Search Report EP 99 30 7609.
Patent Abstracts of Japan, Publication #08314061, Publication date: Nov. 29, 1996 (one page).
Patent Abstracts of Japan, Publication #10207001, Publication date: Jul. 8, 1998 (one page).

* cited by examiner

*Primary Examiner*—Thorl Chea
(74) *Attorney, Agent, or Firm*—Jordan B. Bierman; Bierman, Muserlian and Lucas

(57) ABSTRACT

A thermally developable material comprising a support, an image forming layer containing organic silver salts, and a component layer provided on the image forming layer side, wherein a smooster value on the surface of said image forming layer side of said thermally developable material is not more than 40 mm Hg, and said image forming layer or said component layer contains a fluorine containing surfactant.

6 Claims, 1 Drawing Sheet

THERMALLY DEVELOPABLE MATERIAL

FIELD OF THE INVENTION

The present invention relates to a thermally developable material with excellent transferability and excellent stability over passage of time, as well as stable developability, specifically to a black and white thermally developable photosensitive material.

BACKGROUND OF THE INVENTION

Conventionally, in the medical field, processing solution waste generated along with the wet process for image forming materials has caused problems regarding worakability, and in recent years, a decrease in the processing solution waste has been strongly demanded in terms of environmental protection and space savings. Thus, a technique for light heat photographic material for a technical photographic use is demanded in which exposure can be sufficiently carried out using a laser image setter or a laser imager, so that sharp and bright images with high resolving power can be achieved. Methods are well known such techniques which are described, for example, in U.S. Pat. Nos. 3,152,904 and 3,487,075 and D. Morgan, "Dry Silver Photographic Materials" (Handbook of Imaging Materials, Marcel Dekker, Inc. page 48, 1991), etc. These photosensitive materials are referred to as thermally developable photosensitive materials comprising a support having thereon an organic silver salt, a photosensitive silver halide, and a reducing agent. It is well known that an automatic processor for said thermally developable materials is advantageous in that it does not need relatively large scale processing tanks which are employed in most wet processes, but needs only a compact scale of the normal processing apparatus.

SUMMARY OF THE INVENTION

In recent years, in the medical field, such as that data obtained by photographing with a digital apparatus as a CT (Computed Tomography) image and a MRI (Magnetic Resonance Imaging) image are output, employing an imager, on a film which is processed in conventional photographic processing and the thus processed film is used for medical diagnosis. The use of the above-mentioned thermally developable material for the output of the imager exhibits some advantages such as space saving in placement of processing apparatus, ease in processing operation, and environmental protection. However, since said thermally developable material is usually processed at a high temperature of 120° C. or more, there are some problems, detailed below, (i) transportation failure occasionally occurs when said thermally developable material is thermally developed with an automatic processor having a thermally developing portion;

(ii) marked density variation is often observed after developing a thermally developable material, especially when an unexposed thermally developable material is preserved over a long period of time;

(iii) photographic characteristics such as sensitivity, fogging and the like vary to a great extent, when thermally developable conditions vary, specifically when processing temperature is low.

In view of the foregoing statements, the present invention has been accomplished. An object of the present invention is to provide a thermally developable material with less transportation failure in processing said thermally developable material in an automatic processor, with less density variation after the thermal developing process, and further, with less variation of sensitivity and fogging independent of the processing temperature.

The following two items are very important in the present invention to attain the object the present invention.

(Item 1) A thermally developable material comprising a support having thereon at least a photosensitive layer containing photosensitive silver halide grains and organic silver grains, and said thermally developable material further containing a reducing agent in a photographic component layer provided on a photosensitive layer side, wherein a smooster value on the surface of an outermost layer provided on said photosensitive layer side is not more than 40 mm Hg, and said photographic component layer provided on said photosensitive layer side contains a fluorine containing surfactant.

(Item 2) A thermally developable material comprising a support having thereon at least a photosensitive layer containing photosensitive silver halide grains and organic silver grains, and said thermally developable material further containing a reducing agent in a photographic component layer provided on a photosensitive layer side, wherein a smooster value on the surface of an outermost layer provided opposite to said photosensitive layer, with a support between, is not less than 80 mm Hg, and a photographic component layer provided opposite to said photosensitive layer, with a support between, contains a fluorine containing surfactant.

DETAILED DESCRIPTION OF THE INVENTION

Figure 1:
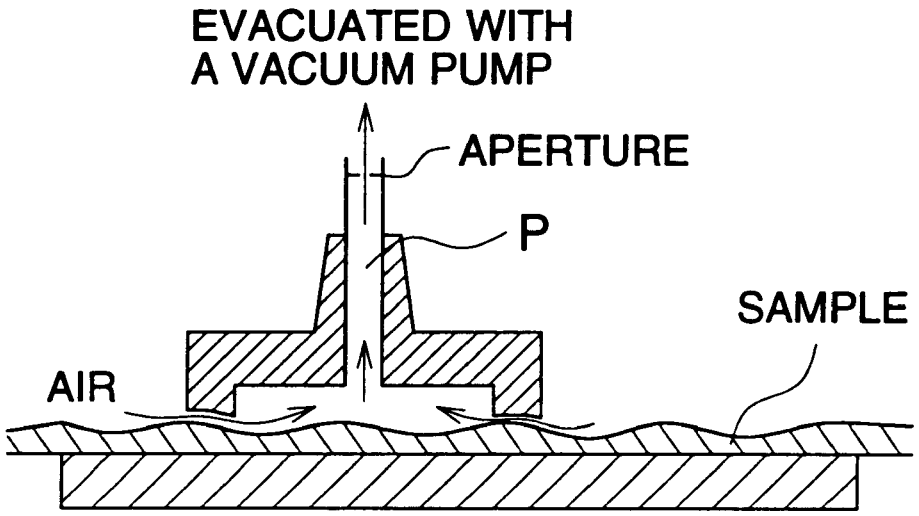
FIG. 1 is an outline of a cross sectional view of an apparatus for measuring a smooster value on the surface of a thermally developable photographic material according to the present invention.

The above-mentioned object of the present invention is attained by the following constitution.

(1) A thermally developable material comprising a support, an image forming layer containing organic silver salts and a component layer provided on the image forming layer side, wherein a smooster value on the surface of said image forming layer side of said thermally developable material is not more than 40 mm Hg, and said image forming layer or said component layer contains a fluorine containing surfactant.

(2) The thermally developable material of item 1, wherein said image forming layer or said component layer contains a reducing agent or a precursor of said reducing agent.

(3) The thermally developable material of item 1, wherein said image forming layer contains photosensitive silver halide grains, and said thermally developable material is a thermally developable photosensitive material.

(4) The thermally developable material of item 1, wherein a smooster value on the surface of said image forming layer side of said thermally developable material is between 0.1 mm Hg and 35 mm Hg.

(5) The thermally developable material of item 1, wherein said thermally developable material comprises a secondary component layer provided opposite to said image forming layer side, and a smooster value on the surface opposite to said image forming layer of said image forming materialis not less than 80 mm Hg, and said secondary component layer contains a fluorine containing surfactant.

(6) The thermally developable material of item 5, wherein said smooster value on the surface opposite to said image forming layer side of said image forming material is from 85 mm Hg to 400 mm Hg.

(7) The thermally developable material of item 1, wherein the content of tabular grains in whole organic silver grains contained in said image forming layer is not less than 60 mol %.

The present invention is offered to provide a reduction of transportation failure when processing a thermally developable material at a high temperature, an improvement of density variation after developing said thermally developable material when preserving said developed thermally developable material over a long period of time, and an improvement of variation of photographic characteristics such as sensitivity and fogging or the like when processing said thermally developable material at a relatively low temperature. These improvements were found to be attainable by establishing a smooster value on the surface of an outermost layer coated on an image forming layer side and/or a smooster value on the surface of an outermost layer provided opposite to said image forming layer, with a support between, to be at a specified region, further by adding a fluorine containing surfactant to at least a photographic component layer. Namely, when the smooster value on each and/or both surfaces of both outermost layers, with a support between them, is specified, and further a fluorine containing surfactant is employed, in thermally developing a thermally developable material, such problems as mentioned above are reduced to result in obtaining an excellent image.

From the viewpoint of employing a fluorine containing surfactant in a thermally developable photosensitive material, a method for improving coatability and static resistence is described in Japanese Patent Publication Open to Public Inspection (hereinafter referred to as JP-A) Nos. 60-244945, 7-173225, and 7-233268. Further, a method for decreasing fog variation when thermally developing a thermally developable material, in which a specified fluorine containing surfactant is employed, is described in JP-A No. 9-281636.

The present invention will now be detailed.

A theramally developable material according to the present invention was accomplished by the following constitution:

said thermally developable material comprises a support having thereon an image forming layer and a component layer provided on said imge forming layer side, and a smooster value on the surface of an outermost layer provided on said omage forming layer side is not more than 40 mm Hg, and further, said component layer or said image forming layer contains a fluorine containing surfactant.

The thermally developable material according to the present invention is applicable to a photosensitive material for not only medical field use, but also printing field use.

The thermal developable material is stable at room temperature and is developed by heating it at high temperature after exposure. Silver image is formed by redox reaction between organic silver salt (functions as an oxidant) and reducing agent caused by heating. The reaction goes on without providing processing liquid such as water from outside. The heating temperature is preferably 80 to 200° C., more preferably 100 to 150° C. In order to obtain a more stable image density, the thermal developable material may be processed by preheating it to the temperature of 5° C. or more higher than the heat development temperature just before the heat development. Term for development is preferably from 10 to 60 seconds. Term for preheating is preferably from 5 to 60 seconds.

The thermal developable material is thermally developed in the following way. The thermally developable material is transported to be termally processed, between a heat drum which comprises a heating device having diameter of not less than 200 mm and a transportation belt provided against said drum, or between said heat drum and a device comprising several auxiliary transportation drums having diameter of 10 to 50 mm provided along with said heating drum in an adiabatic chamber, keeping the image forming layer side contacting with said heating drum. Or the thermally developable material is transported to be thermally processed through a device having plurality of rollers positioned alternatively with each other, or plurality of rollers positioned oppositely with each other, capable of transporting the thermally developable material straight in an adiabatic chamber heated by a heating device, or through a device comprising the above-mentioned rollers which themselves comprise heating means.

In the present invention, a smooster value on the surface of an outermost layer on an image forming layer side of an unexposed, undeveloped thermally developable photosensitive material, or a smooster value on the surface of an outermost layer, provided opposite to the image forming layer side, of an unexposed thermally developable material is defined as suction pressure, which is measurable under the following conditions.

The measurement of suction pressure is conducted by employing a Smooster SM-6B apparatus produced by Toa Electric Kogyo Co. As illustrated in FIG. 1, by employing the apparatus utilizing a vacuum type air micrometer, variations of the amount of air sucked in through a measuring head, in accordance with the coarseness of a measured surface is noted as variation of pressure (mm Hg). High pressure corresponds to large unevenness of the surface and/or much roughness of the surface. As illustrated in FIG. 1, the measuring head was put on the surface of a sample to be measured, and inside air of said head is exhausted through an aperture having a fixed-size opening, and the atmospheric pressure is then noted. The thus noted atmospheric pressure is indicated as the smooster value. Prior to the measurement for said smooster value, a measured sample is allowed to stand for 2 hours under conditions of 23° C. and relative humidity of 48%.

As an embodiment of the present invention, (a) a smooster value on the surface of an outermost layer provided on an image forming layer side is not more than 40 mm Hg, is preferably from 0.1 mm Hg to 35 mm Hg, and is more preferably from 1 mm Hg to 32 mm Hg, further is most preferably from 2 mm Hg to 32 mm Hg.

As another embodiment of the present invention, (b) a smooster value on the surface of an outermost layer provided opposite to an image forming layer, with a support between, is not less than 80 mm Hg, preferably from 85 to 400 mm Hg, more preferably from 90 to 250 mm Hg.

As a preferable embodiment of the present invention, (c) a smooster value on the surface of an outermost layer provided on an image forming layer side is not more than 40 mm Hg, and a smooster value on the surface of an outermost layer provided opposite to said image forming layer is not less than 80 mm Hg.

The smooster value is regulated by the amount of a binder such as polyvinyl butyral, cellulose acetatebutylate, polyester and polymer latex, by particle size, by form and by the additional amount of a matting agent, by the additional amount and kind of a compound which can vary the physical property of the binder, as well as by coating, and drying conditions. In this invention, by combining the above-mentioned factors, the optimal smooster value can be obtained.

The thermally developable material according to the present invention comprises a support having thereon an image forming layer containing organic silver salts and a component layer provided on said image forming layer side. In the present invention, said component layer means a layer other than the image forming layer. Examples of said component layer include a protective layer protecting an image forming layer (being usually a layer provided on the surface of an outermost layer), a subbing layer, an adhesion layer provided between a sublayer and an image forming layer, an antihalation layer, or the like. Further, plurality of image forming layers and subbing layers may be employed.

Furthermore, a secondary component layer may be provided opposite to an image forming layer, with a support between. Examples of said secondary component layer include a subbing layer, a backing layer which is provided for the purpose of enhancing an antistatic property, and the like.

The image forming layer may include a reducing agent or a precursor of said reducing agent other than organic silver salts. The above-mentioned reducing agent or precursor of the reducing agent may be incorporated in a component layer such as a protective layer and the like. In the case of incorporating said reducing agent or precursor of the reducing agent in said component layer, these agents is preferably incorporated in a layer adjacent to the image forming layer.

When the thermally developable material is a thermally developable photosensitive material, photosensitive silver halide grains may be incorporated in the image forming layer.

Thickness of the image forming layer and a photosensitive image forming layer is preferably between 1.0 and 20.0 $\mu$m, and is more preferably between 1.5 and 10.0 $\mu$m.

Glass transition temperature of a binder used for forming a protective layer is preferably higher than that of a binder for forming an image forming layer. Further, said protective layer may preferably contain a matting agent, furthermore, said protective layer may contain a lubricant such as a wax and paraffin. Thickness of said protective layer is preferably between 0.5 and 20.0 $\mu$m, and is more preferably between 1.5 and 10.0 $\mu$m.

A fluorine containing surfactant may be incorporated in any of the image forming layer, the component layer or the secondary component layer, however, said fluorine containing surfactant is preferably incorporated in a layer provided on the image forming layer side, or in an outermost layer provided opposite to said image forming layer, for example, a protective layer.

As said fluorine containing surfactant, any of an anionic, cationic or nonionic surfactant may be used, and of these, a nonionic surfactant is preferable. Examples of said nonionic compound include not only a low molecular compound but also a high molecular compound. Examples of these compounds are described in JP-A Nos. 60-244945, 63-306437, 7-233268, and 7-173225. Of these, the preferable fluorine containing surfactant is a (meth)acrylate polymer which has a fluorinated alkyl group on its side chain, and which preferably has a number average molecular weight of not more than 30,000 in terms of standard polystyrene conversion, and more preferably from 2,000 to 10,000.

As a chemical structural unit of acrylate or methacrylate having a fluorinated alkyl group on its side chain, for example, the following formula (A-a) or formula (A-b) is cited.

Formula (A-a)

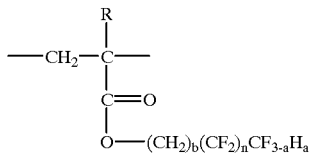

Formula (A-b)

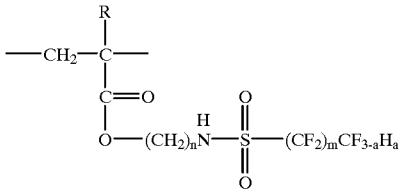

In the formula (A-a), R represents a methyl group, n represents an integer of 0 to 20, a represents an integer of 0 to 2, and b represents an integer of 0 or 1. In the formula (A-b), R represents a hydrogen atom or a methyl group, n represents an integer of 0 to 10, m represents an integer of 0 to 2, and a represents an integer of 0 to 2. Specific exemplified units are shown below. However, the present invention is not limited to these examples.

A-1

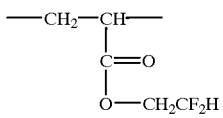

A-2

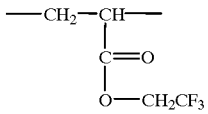

A-3

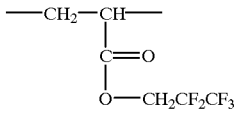

A-4

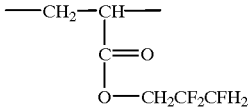

A-5

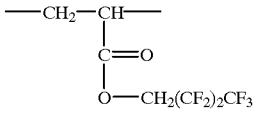

A-6

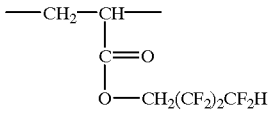

A-7

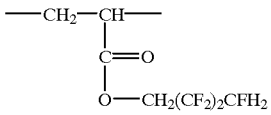

-continued
A-8
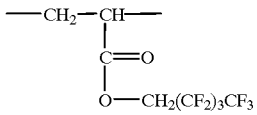
A-9
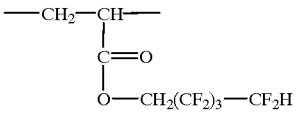
A-10
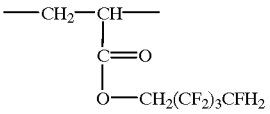
A-11
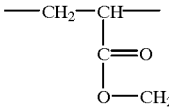
A-12
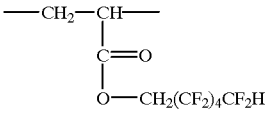
A-13
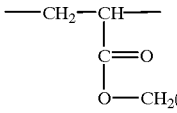
A-14
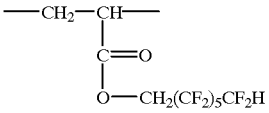
A-15
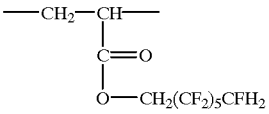
A-16
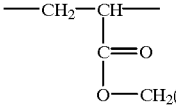
A-17
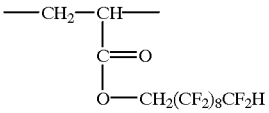
A-18
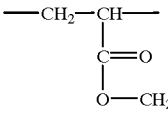
A-19
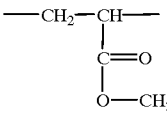
-continued
A-20
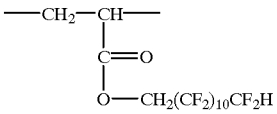
A-21
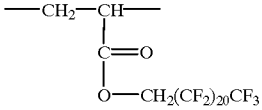
A-22
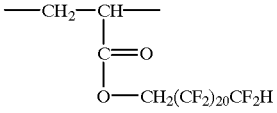
A-23
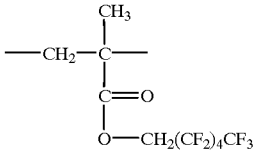
A-24
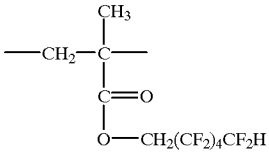
A-25
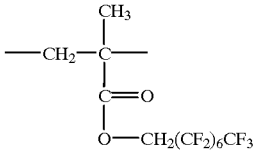
A-26
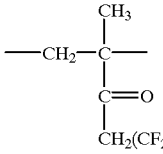
A-27
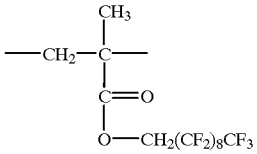
A-28
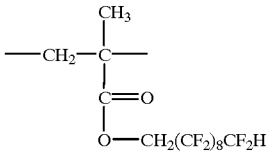
A-29
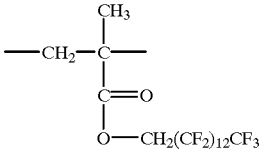

-continued
A-30
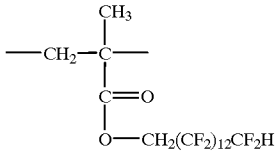
A-31
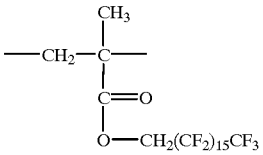
A-32
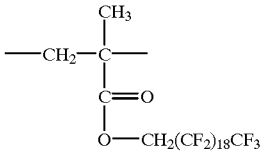
A-33
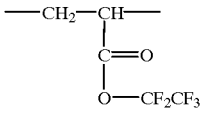
A-34
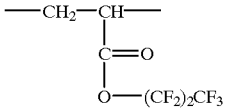
A-35
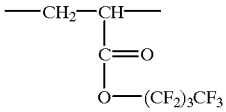
A-36
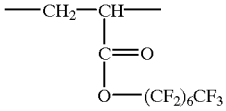
A-37
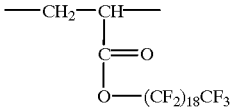
A-38
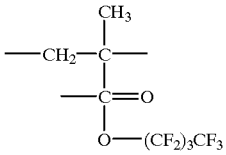
A-39
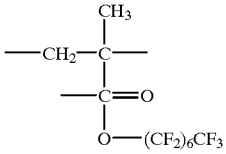
-continued
A-40
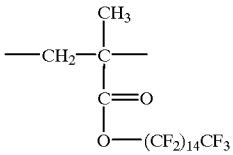
A-41
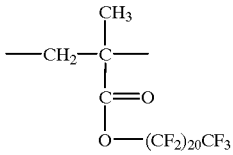
A-42
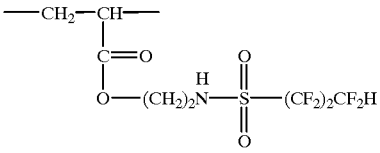
A-43
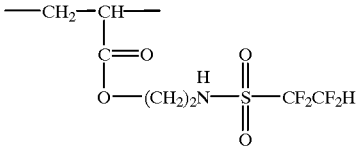
A-44
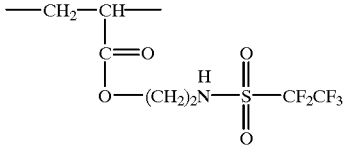
A-45
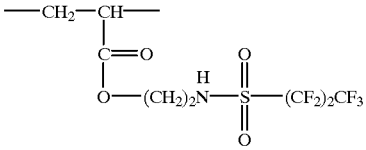
A-46
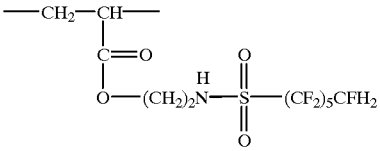
A-47
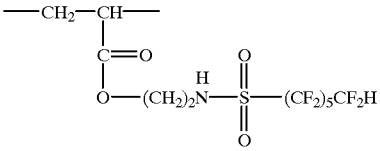
A-48
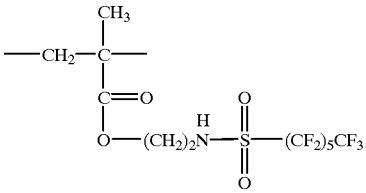

-continued
A-49
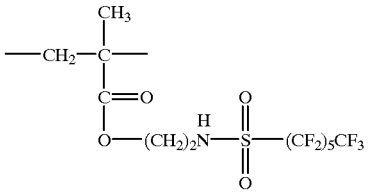
A-50
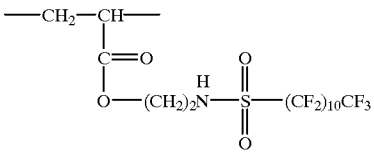
A-51
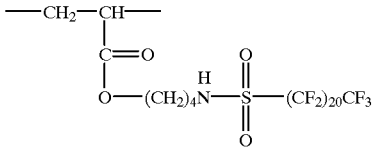
A-52
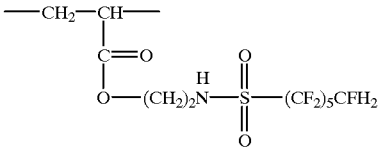
A-53
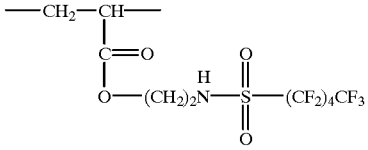
A-54
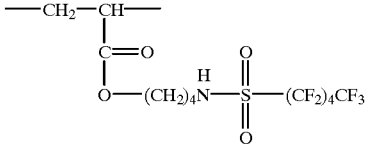
A-55
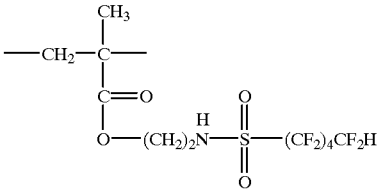
A-56
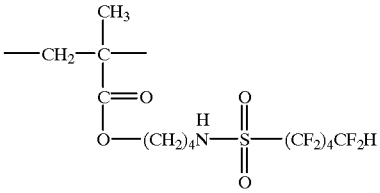
-continued
A-57
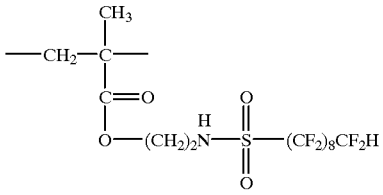
A-58
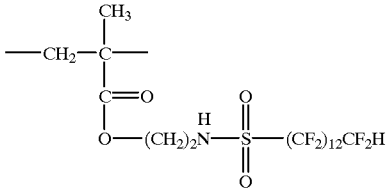
A-59
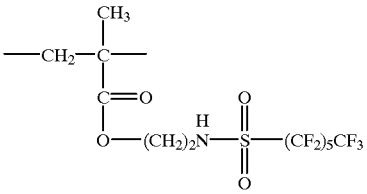
A-60
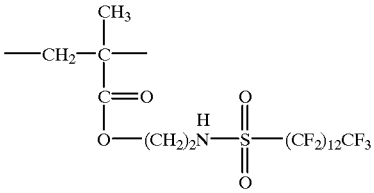
A-61
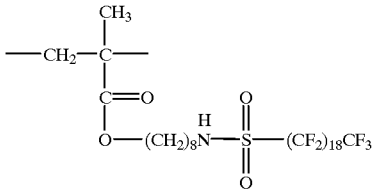
A-62
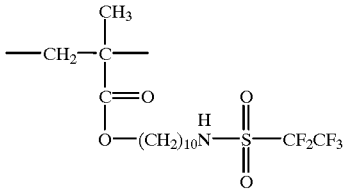
A-63
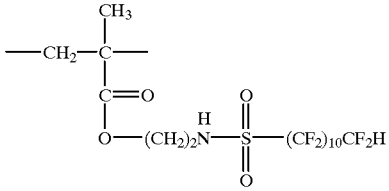

-continued

A-64

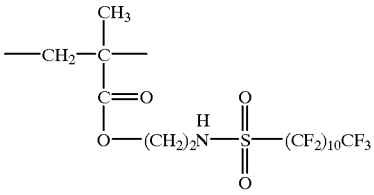

A-65

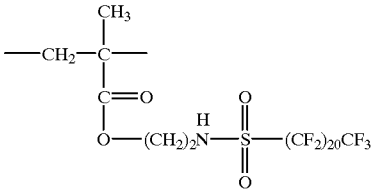

(Meth)acrylate polymer having a fluorinated alkyl group on its side chain preferably further contains an alkyleneoxide group or an alkyl group on its side chain.

As a (meth)acrylate structural unit of said (meth)acrylate polymer having the alkyleneoxide group on its side chain, the following formula (B) can be cited.

Formula (B)

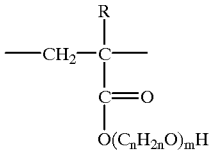

In the formula (B), R represents a hydrogen atom or a methyl group, n represents an integer of 1 to 6, and m represents an integer of 1 to 10. Specific exemplified compounds are shown below. However, the present invention is not limited to these examples.

B-1

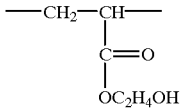

B-2

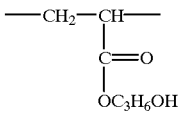

B-3

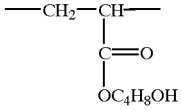

B-4

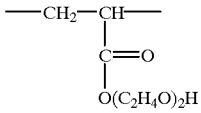

-continued

B-5

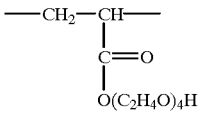

B-6

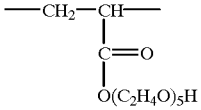

B-7

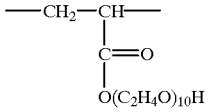

B-8

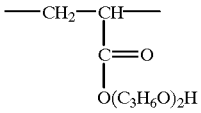

B-9

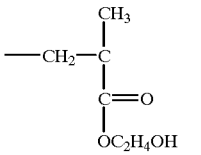

B-10

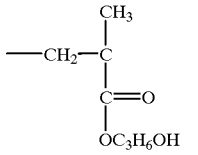

B-11

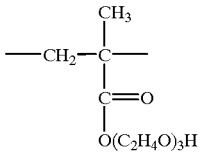

B-12

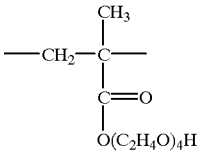

B-13

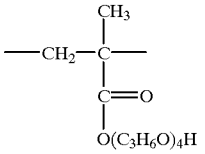

B-14

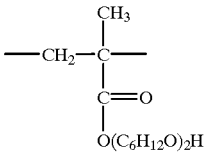

As a (meth)acrylate structural unit of said (meth)acrylate polymer having the alkyl group on its side chain, the following formula (C) is cited.

Formula (C)
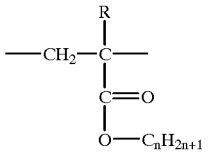
In the formula (C), R represents a hydrogen atom or a methyl group, and n represents an integer of 1 to 22. Specific exemplified units are shown below. However, the present invention is not limited to these examples.
C-1
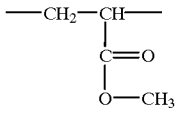
C-2
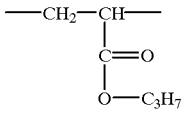
C-3
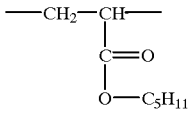
C-4
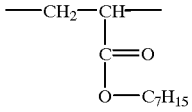
C-5
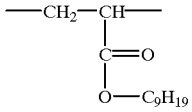
C-6
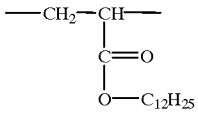
C-7
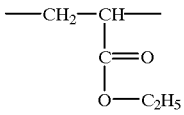
C-8
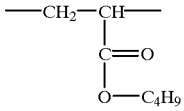
C-9
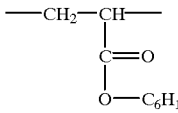
-continued
C-10
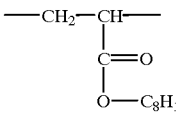
C-11
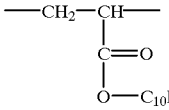
C-12
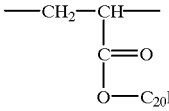
C-13
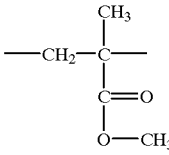
C-14
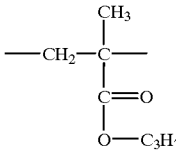
C-15
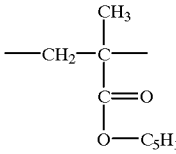
C-16
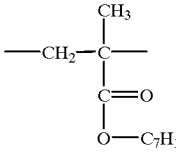
C-17
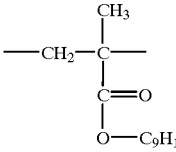
C-18
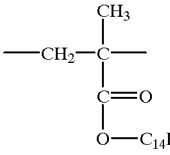
C-19
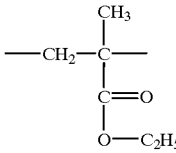

-continued

C-20

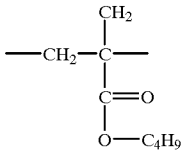

C-21

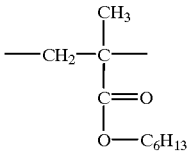

C-22

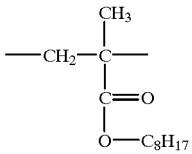

C-23

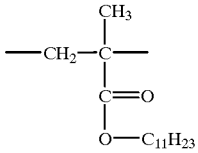

C-24

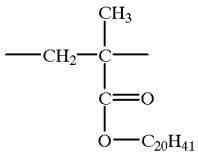

(Meth)acrylate polymer having a fluorinated alkyl group on its side chain may contain an aryl group, an allylene group, or the like on its side chain. Chemical structural units having said aryl group, an allylene group or the like are, for example, shown below.

D-1

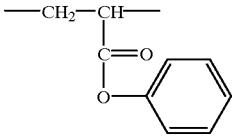

D-2

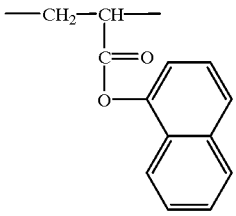

-continued

D-3

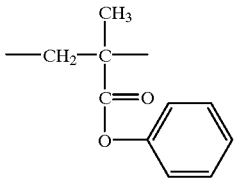

D-4

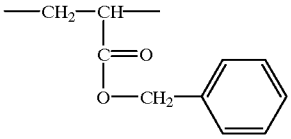

D-5

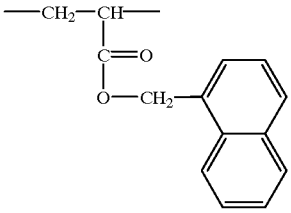

D-6

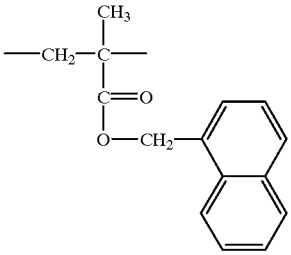

D-7

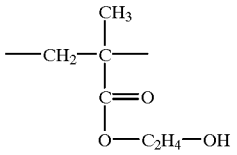

(Meth)acrylate polymer having a fluorinated alkyl group on its side chain may further contain chemical structural unit other than the above-mentioned chemical structure units, for example, the following units are available.

E-1

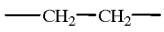

E-2

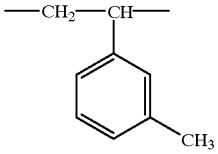

E-3

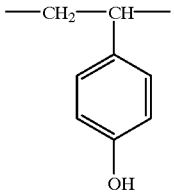

-continued

E-4

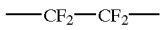

E-5

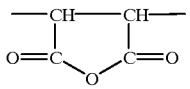

E-6

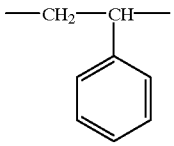

E-7

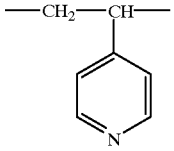

E-8

E-9

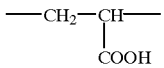

Specific exemplified (meth)acrylate polymers, consisting of the above-mentioned chemical structural units, are listed in the following Table 1. However, the present invention is not limited to these exemplified polymers.

TABLE 1

| | A-17 | A-59 | B-7 | B-13 | C-16 | D-4 | D-7 | E-9 |
|---|---|---|---|---|---|---|---|---|
| FS-1 | 60 | | 40 | | | | | |
| FS-2 | 60 | | 20 | 20 | | | | |
| FS-3 | 50 | | 25 | 25 | | | | |
| FS-4 | 40 | | 30 | 30 | | | | |
| FS-5 | 60 | | | | 40 | | | |
| FS-6 | 60 | | | | | 40 | | |
| FS-7 | 60 | | | | | | | 40 |
| FS-8 | | 70 | 30 | | | | | |
| FS-9 | | 60 | | 40 | | | | |
| FS-10 | | 50 | | | | | 30 | 20 |

(Monomer content is listed in terms of percentage)

Another type of a preferable fluorine containing surfactant is represented by the following formula (F-A) or (F-B).

$Rf-(A)_n$ Formula (F-A)

$Rf-(A)_n-Rf'$ Formula (F-B)

wherein, each of Rf and Rf' represents at least a fluorine containing aliphatic group, A represents at least an alkyleneoxide group, n represents an integer of 1 or more, and Rf and Rf' may be the same or different.

The formula (F-A) and (F-B) will now be detailed.

Said fluorine containing aliphatic group represented by Rf or Rf' is a straight, branched and cyclic aliphatic group, or combination of these aliphatic groups (e.g. an alkylcyclic aliphatic group). Examples of preferable fluorine containing aliphatic group include a fluoroalkyl group having 1 to 20 carbon atoms (e.g. $—C_4F_9$; $—C_8F_{17}$), a sulfofluoroalkyl group [e.g. $(C_7F_{15}SO_3)—$, $(C_8F_{17}SO_3—)$], and a $C_nF_{2n+1}SO_2N(R_1)R_2—$ group having 1 to 20 carbon atoms [herein, $R_1$ represents a hydrogen atom, an alkyl group having 1 to 20 carbon atoms, an alkoxy group having 1 to 20 carbon atoms, alkylcarboxyl group having 1 to 20 carbon atoms, or aryl group, $R_2$ represents an alkylene group having 1 to 20 carbon atoms, or alkylenecarboxyl group having 1 to 20 carbon atoms, n represents an integer of 1 to 20, for example, $C_7F_{15}SO_2N(C_2H_5)CH_2—$, $C_8F_{17}SO_2N(CH_2COOH)C_3H_6—$], and these fluorine containing aliphatic groups and sulfofluoroalkyl group further contains a substituent group. A represents a group containing an alkyleneoxide group such as an ethyleneoxide group, a propyleneoxide group, or an iso-propyleneoxide group and these alkyleneoxide groups further contain a substituent group such as an amino group at their terminal positions. Specific exemplified compounds are listed below. However, the present invention is not limited thereto.

(F-1) $C_8F_{17}SO_2N(C_2H_5)CH_2(CH_2CH_2O)_{12}H$
(F-2) $C_8F_{17}(CH_2CH_2O)_8C_8F_{17}$
(F-3) $C_8F_{17}(CH_2CH_2O)_{12}C_8F_{17}$
(F-4) $C_7F_{15}(CH_2CH_2O)_{10}C_7F_{15}$
(F-5) $C_{12}F_{25}(CH_2CH_2O)_{10}C_{12}F_{25}$
(F-6) $C_8F_{17}(CH_2CH_2O)_{17}C_8F_{17}$
(F-7) $C_7F_{15}SO_3^{-+}NH_3(CH_2CH_2O)_{12}CH_2CH_2NH_3^{+-}O_3SC_7H_{15}$
(F-8) $C_7F_{15}SO_2N(C_2H_5)CH_2(CH_2CH_2O)_{12}CH_2(CH_3)NO_2SC_7F_{15}$

As other preferable compounds, compounds (1) through (81) are described in JP-A No. 2-82247, on page 4, on upper left column, through on page 8, on upper left column.

Details of a thermally developable photosensitive material are disclosed, as described above, in, for example, U.S. Pat. Nos. 3,152,904 and 3,457,075, and D. Morgan, "Dry Silver Photographic Material" and D. Morgan and B. Shely, "Thermally Processed Silver Systems" (Imaging Processes and Materials) Neblette, 8th Edition, edited by Sturge, V. Walworth, and A. Shepp, page 2, 1969, etc. In the present invention, a thermally developable photosensitive material is thermally developed at temperature of 80 to 140° C. so as to obtain images without fixation, so that the silver halide and the organic silver salt in an unexposed portion are not removed and remain in the photosensitive material.

Silver halide grains used in the present invention function as a light sensor. In the present invention, in order to minimize the translucence after image formation and to obtain excellent image quality, the average grain size is preferably minute. The average grain size is preferably not more than 0.1 μm; is more preferably between 0.01 and 0.1 μm, and is most preferably between 0.02 and 0.08 μm. The average grain size as described herein implies the ridge line length of a silver halide grain when it is a so-called regular crystal which is either cubic or octahedral. When the grain is not a regular crystal, for example, when it is a spherical, cylindrical, or tabular grain, the grain size is the diameter of a sphere having the same volume as each of those grains. Furthermore, silver halide is preferably monodispersed. The monodisperse as described herein means that the degree of monodispersibility obtained by the formula described below is not more than 40 percent. The more preferred grains are those which exhibit the degree of monodispersibility is not more than 30 percent, and the particularly preferred grains are those which exhibit a degree of monodispersibility is between 0.1 and 20 percent.

Degree of monodispersibility=(standard deviation of grain diameter)/(average of grain diameter)×100

In the present invention, the average grain diameter is preferably not more than 0.1 μm, and grains are preferably monodispersed. When grains are formed in this range, the graininess of images is also improved.

There is no particular limitation on the silver halide grain shape. However, a high ratio occupying a Miller index [100] plane is preferred. This ratio is preferably at least 50 percent; is more preferably at least 70 percent, and is most preferably at least 80 percent. The ratio occupying the Miller index [100] plane can be obtained based on T. Tani, J. Imaging Sci., 29, 165 (1985) in which adsorption dependency of a [111] plane and a [100] plane is utilized.

Furthermore, another preferred silver halide shape is a tabular grain. The tabular grain as described herein is a grain having an aspect ratio represented by r/h of not less than 3, wherein r represents a grain diameter in $\mu$m obtained as the square root of the projection area, and h represents thickness in $\mu$m in the vertical direction. Of these, the aspect ratio is preferably between 3 and 50. The grain diameter is preferably not more than 0.1 $\mu$m, and is more preferably between 0.01 and 0.08 $\mu$m. These are described in U.S. Pat. Nos. 5,264,337, 5,314,789, 5,320,958, and others, by which desired tabular grains can readily be prepared. When these tabular grains are used, image sharpness is further improved.

The composition of silver halide is not particularly limited and may be any of silver chloride, silver chlorobromide, silver chloroiodobromide, silver bromide, silver iodobromide, or silver iodide. The photographic emulsion employed in the present invention can be prepared employing methods described in P. Glafkides, "Chimie et Physique Photographique" (published by Paul Montel, 1967), G. F. Duffin, "Photographic Emulsion Chemistry" (published by The Focal Press, 1966), V. L. Zelikman et al., "Making and Coating Photographic Emulsion" (published by The Focal Press, 1964). Namely, any of several acid emulsions, neutral emulsions, ammonia emulsions, and the like may be employed. Furthermore, when grains are prepared by allowing soluble silver salts to react with soluble halide salts, a single-jet method, a double-jet method, or combinations thereof may be employed. The resulting silver halide may be incorporated into an image forming layer utilizing any practical method, and at such time, silver halide is placed adjacent to a reducible silver source. Furthermore, silver halide may be prepared by converting a part or all of the silver in an organic silver salt formed through the reaction of an organic silver salt with halogen ions into silver halide. Silver halide may be previously prepared and the resulting silver halide may be added to a solution to prepare the organic silver salt, or combinations thereof may be used, however the latter is preferred. Generally, the content of silver halide in organic silver salt is preferably between 0.75 and 30 weight percent.

In order to improve intensity reciprocity law failure, silver halide employed in the present invention is preferably comprised of ions of metals or complexes thereof, in transition metal belonging to Groups 6 through 10 of the Periodic Table. As the above-mentioned metals, preferred are W, Fe, Co, Ni, Cu, Ru, Rh, Pd, Re, Os, Ir, Pt and Au.

These metals may be incorporated into silver halide in the form of complexes. In the present invention, regarding the transition metal complexes, six-coordinate complexes represented by the general formula described below are preferred.

General formula $$(ML_6)^m$$

wherein M represents a transition metal selected from elements in Groups 6 through 10 of the Periodic Table; L represents a coordinating ligand; and m represents 0, −1, −2, or −3. Specific examples represented by L include halides (fluorides, chlorides, bromides, and iodides), cyanides, cyanates, thiocyanates, selenocyanates, tellurocyanates, each ligand of azido and aquo, nitrosyl, thionitrosyl, etc., of which aquo, nitrosyl and thionitrosyl are preferred. When the aquo ligand is present, one or two ligands are preferably coordinated. L may be the same or different.

The particularly preferred specific example of M is rhodium (Rh), ruthenium (Ru), rhenium (Re) or osmium (Os).

Specific examples of transition metal ligand complexes are described below.

1: $[RhCl_6]^{3-}$
2: $[RuCl_6]^{3-}$
3: $[ReCl_6]^{3-}$
4: $[RuBr_6]^{3-}$
5: $[OsCl_6]^{3-}$
6: $[IrCl_6]^{2-}$
7: $[Ru(NO)Cl_5]^{2-}$
8: $[RuBr_4(H_2O)]^{2-}$
9: $[Ru(NO)(H_2O)Cl_4]^{-}$
10: $[RhCl_5(H_2O)]^{2-}$
11: $[Re(NO)Cl_5]^{2-}$
12: $[Re(NO)CN_5]^{2-}$
13: $[Re(NO)ClCN_4]^{2-}$
14: $[Rh(NO)_2Cl_4]^{-}$
15: $[Rh(NO)(H_2O)Cl_4]^{-}$
16: $[Ru(NO)CN_5]^{2-}$
17: $[Fe(CN)_6]^{3-}$
18: $[Rh(NS)Cl_5]^{2-}$
19: $[Os(NO)Cl_5]^{2-}$
20: $[Cr(NO)Cl_5]^{2-}$
21: $[Re(NO)Cl_5]^{-}$
22: $[Os(NS)Cl_4(TeCN)]^{2-}$
23: $[Ru(NS)Cl_5]^{2-}$
24: $[Re(NS)Cl_4(SeCN)]^{2-}$
25: $[Os(NS)Cl(SCN)_4]^{2-}$
26: $[Ir(NO)Cl_5]^{2-}$
27: $[Ir(NS)Cl_5]^{2-}$

One type of these metal ions or complex ions may be employed and the same type of metals or the different type of metals may be employed in combinations of two or more types. Generally, the content of these metal ions or complex ions is suitably between $1\times10^{-9}$ and $1\times10^{-2}$ mole per mole of silver halide, and is preferably between $1\times10^{-8}$ and $1\times10^{-4}$ mole. Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation. The addition may be carried out several times by dividing the added amount. Uniform content in the interior of a silver halide grain can be carried out. As described in JP-A Nos. 63-29603, 2-306236, 3-167545, 4-76534, 6-110146, 5-273683, etc., incorporation can be carried out so as to result in distribution formation in the interior of a grain. These metal compounds can be dissolved in water or a suitable organic solvent (for example, alcohols, ethers, glycols, ketones, esters, amides, etc.) and then added.

Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening.

In the invention, the photosensitive silver halide grains may be not desalted after forming the grains, but in cases where desalting is carried out, the grains can be desalted by employing well known washing methods in this art such as a noodle method and a flocculation method, etc.

The photosensitive silver halide grains used in the present invention is preferably subjected to a chemical sensitization. As preferable chemical sensitizations, well known chemical sensitizations in this art such as a sulfur sensitization, a selenium sensitization and a tellurium sensitization are usable. Furthermore, a noble metal sensitization using gold, platinum, palladium and iridium compounds and a reduction sensitization are available. As the compounds preferably used in the sulfur sensitization, the selenium sensitization and the tellurium sensitization, well known compounds can be used and the compounds described in JP-A No. 7-128768 are usable. Examples of the compounds used in the noble metal sensitization include chloroauric acid, potassium chloroaurate, potassium aurithiocyanate, gold sulfide, gold selenide, compounds described in U.S. Pat. No. 2,448,060 and British Patent No. 618,061. Examples of the compounds used in the reduction sensitization include ascorbic acid, thiourea dioxide, stannous chloride, aminoiminomethanesulfinic acid, hydrazine derivatives, borane compounds, silane compounds and polyamine compounds. The reduction sensitization can be carried out by ripening an emulsion of which pH and pAg are kept to not less than 7 and not more than 8.3 respectively. Furthermore, the reduction sensitization can be carried out by introducing a single addition part of silver ion during the grains being formed.

In the present invention, organic silver salts are reducible silver sources and preferred are organic acids and silver salts of hetero-organic acids having a reducible silver ion source, specifically, long chain (having from 10 to 30 carbon atoms, but preferably from 15 to 25 carbon atoms) aliphatic carboxylic acids and nitrogen-containing heterocylic rings. Organic or inorganic silver salt complexes are also useful in which the ligand has a total stability constant for silver ion of 4.0 to 10.0. Examples of preferred silver salts are described in Research Disclosure (abbreviated as RD), Items 17029 and 29963, and include the following; organic acid salts (for example, salts of gallic acid, oxalic acid, behenic acid, arachidinic acid, stearic acid, palmitic acid, lauric acid, etc.); carboxyalkylthiourea salts [for example, 1-(3-carboxypropyl)thiourea, 1-(3-carboxypropyl)-3,3-dimethylthiourea, etc.]; silver complexes of polymer reaction products of aldehyde with hydroxy-substituted aromatic carboxylic acid [for example, aldehydes (formaldehyde, acetaldehyde, butylaldehyde, etc.), hydroxy-substituted acids (for example, salicylic acid, benzoic acid, 3,5-dihydroxybenzoic acid, 5,5-thiodisalicylic acid], silver salts or complexes of thioenes [for example, 3-(2-carboxyethyl)-4-hydroxymethyl-4-(thiazoline-2-thioene and 3-carboxymethyl-4-thiazoline-2-thioene)], complexes of silver with nitrogen acid selected from imidazole, pyrazole, urazole, 1,2,4-thiazole, and 1H-tetrazole, 3-amino-5-benzylthio-1,2,4-triazole and benztriazole or salts thereof; silver salts of saccharin, 5 -chlorosalicylaldoxime, etc.; and silver salts of mercaptides. Of these, the preferred silver salts are silver behenate, silver arachidinate and silver stearate.

Organic silver salts can be prepared by mixing a water-soluble silver compound with a compound which forms a complex with silver, and employed preferably are a normal precipitation, a reverse precipitation, a double-jet precipitation, a controlled double-jet precipitation as described in JP-A No. 9-127643, etc. For example, after an organic alkali metal salt soap (e.g., sodium behenate, sodium arachidinate, etc.) is prepared by adding an organic acid to an alkali metal salt (e.g., sodium hydroxide, potassium hydroxide, etc.), the above-mentioned soap and silver nitrate are mixed to produce crystals of the organic silver salt. Preparing the organic silver salt may be performed in the presence of silver halide.

In the present invention, organic silver salts have an average grain diameter of not more than 2 $\mu$m and are monodispersed. The average diameter of the organic silver salt as described herein is, when the grain of the organic salt is, for example, a spherical, cylindrical, or tabular grain, a diameter of the sphere having the same volume as each of these grains. The average grain diameter is preferably between 0.05 and 1.5 $\mu$m, and is most preferably between 0.05 and 1.0 $\mu$m. Furthermore, the monodisperse as described herein is the same as silver halide grains and preferred monodispersibility is between 1 and 30 percent. Furthermore, the tabular grains preferably occupy not less than 60 mol % of all the organic silver salt. In the present invention, the tabular grain is the grain of which ratio of an average size to a thickness, that is, an aspect ratio (abbreviated as AR), is not less than 3.

$$AR=(\text{average size } (\mu m))/(\text{thickness } (\mu m))$$

To obtain the above-mentioned shapes of the organic silver salt, it is possible to disperse and pulverize the aforesaid crystals of the organic silver salt in the presence of a surfactant, etc. employing a ball mill, etc. When grains are prepared within this range, images with high density and excellent stability can be obtained.

In the present invention, to prevent devitrification of the photosensitive material, the sum total of silver contained in both the photosensitive silver halide and the organic silver salt is preferably 0.5 to 2.2 g per $m^2$. When silver grains are prepared within this range, high contrast images can be obtained. Ratio of an amount of the photosensitive silver halide to the sum total of silver is preferably not more than 50 wt %, more preferably not more than 25 wt %, and is specifically preferably between 0.1 wt % and 15 wt %.

A reducing agent is preferably incorporated into the thermally developable photosensitive material to which the present invention is applied. Examples of suitable reducing agents are described in U.S. Pat. Nos. 3,770,448, 3,773,512, and 3,593,863, and RD Items 17029 and 29963, and include the following.

Aminohydroxycycloalkenone compounds (for example, 2-hydroxypiperidino-2-cyclohexane); esters of amino reductones as the precursor of reducing agents (for example, pieridinohexose reducton monoacetate); N-hydroxyurea derivatives (for example, N-p-methylphenyl-N-hydroxyurea); hydrazones of aldehydes or ketones (for example, anthracenealdehyde phenylhydrazone; phosphamidophenols; phosphamidoanilines; polyhydroxybenzenes (for example, hydroquinone, t-butylhydroquinone, isopropylhydroquinone, and (2,5-dihydroxy-phenyl) methylsulfone); sulfhydroxamic acids (for example, benzenesulfhydroxamic acid); sulfonamideanilines (for example, 4-(N-methanesulfonamide)aniline); 2-tetrazolylthiohydroquinones (for example, 2-methyl-5-(1-phenyl-5-tetrazolylthio)hydroquinone); tetrahydroquionoxalines (for example, 1,2,3,4-tetrahydroquinoxaline); amidoxines; azines (for example, combinations of aliphatic carboxylic acid arylhydrazide with ascorbic acid); combinations of polyhydroxybenzenes and hydroxylamines, reductones and/or hydrazine; hydroxamic acids; combinations of azines with sulfonamidephenols; α-cyanophenylacetic acid derivatives; combinations of bis-β-naphthol with 1,3-dihydroxybenzene derivatives; 5-pyrazolones, sulfonamidephenol reducing agents, 2-phenylindane-1,3-dione, etc.; chroman; 1,4-dihydropyridines (for example, 2,6-dimethoxy-3,5-dicarboethoxy-1,4-dihydropyridine); bisphenols [for example, bis(2-hydroxy-3-t-butyl-5-methylphenyl)methane, bis(6-hydroxy-m-tri)mesitol, 2,2-bis(4-hydroxy-3-methylphenyl)propane, 4,5-ethylidene-bis(2-t-butyl-6-methyl)phenol], UV-sensitive ascorbic acid derivatives and 3-pyrazolidones. Of these, particularly preferred reducing agents are hindered phenols. As hindered phenols, listed are compounds represented by the general formula (A) described below.

General formula (A)

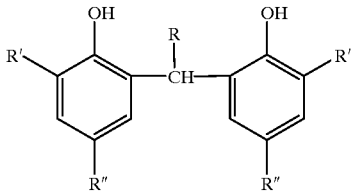

wherein R represents a hydrogen atom or an alkyl group having from 1 to 10 carbon atoms (for example, —$C_4H_9$, 2,4,4 -trimethylpentyl), and R' and R" each represents an alkyl group having from 1 to 5 carbon atoms (for example, methyl, ethyl, t-butyl).

Specific examples of the compounds represented by the general formula (A) are described below. However, the present invention is not limited to these examples.

A-1

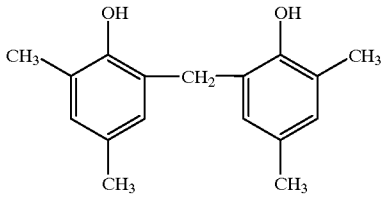

-continued

A-2

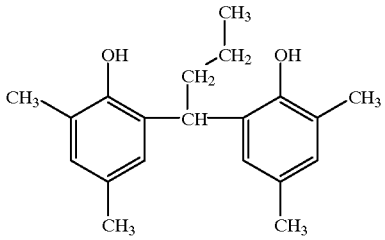

A-3

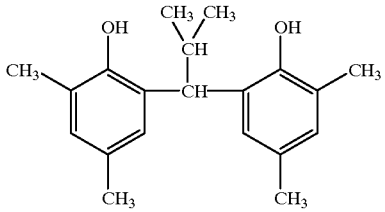

A-4

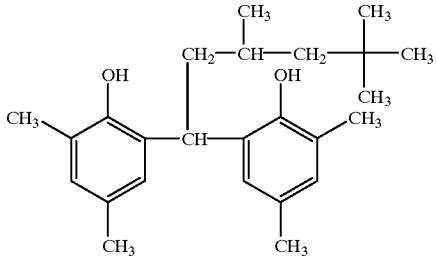

A-5

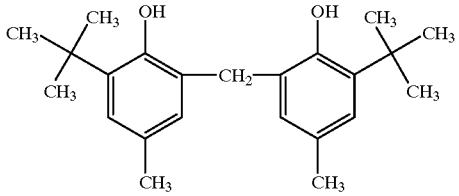

A-6

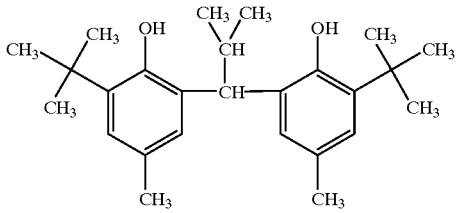

A-7

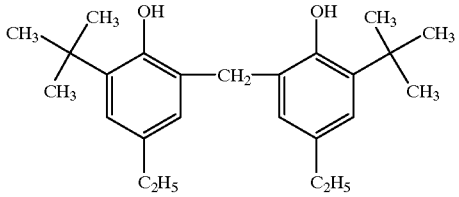

The used amount of reducing agents first represented by the above-mentioned general formula (A) is preferably between $1\times10^{-2}$ and 10 moles per mole of silver, and is most preferably between $1\times10^{-2}$ and 1.5 moles.

Binders suitable for the thermally developable photosensitive material to which the present invention is applied are transparent or translucent, and generally colorless. Binders are natural polymers, synthetic resins, and polymers and copolymers, other film forming media; for example, gelatin, gum arabic, poly(vinyl alcohol), hydroxyethyl cellulose, cellulose acetate, cellulose acetatebutylate, poly(vinyl pyrrolidone), casein, starch, poly(acrylic acid), poly (methylmethacrylic acid), poly(vinyl chloride), poly (methacrylic acid), copoly(styrene-maleic acid anhydride), copoly(styrene-acrylonitrile), copoly(styrene-butadiene), poly(vinyl acetal) series [for example, poly(vinyl formal) and poly(vinyl butyral)], poly(ester) series, poly(urethane) series, phenoxy resins, poly(vinylidene chloride), poly (epoxide) series, poly(carbonate) series, poly(vinyl acetate) series, cellulose esters, poly(amide) series. These may be hydrophilic or hydrophobic. However, in the present invention, the binder is preferably transparent to reduce fogging after thermal development. As the preferable binder, are cited poly(vinyl butyral), cellulose acetate, cellulose acetatebutylate, polyester, polycarbonate, polyacrylic acid, polyurethane, ect. Of these, poly(vinyl butyral), cellulose acetate, cellulose acetatebutylate and polyester are preferably employed.

To protect the surface of the photosensitive material and to prevent abrasion marks, it is possible to coat a non-photosensitive layer upon a photosensitive layer. Kind of a binder used for the non-photosensitive layer may be the same as that used for the photosensitive layer or different from that used for the photosensitive layer.

In the present invention, for the purpose of accelerating the thermal development speed, the amount of the binder in a photosensitive layer is preferably between 1.5 and 10 $g/m^2$, and is more preferably between 1.7 and 8 $g/m^2$. When the amount is below 1.5 $g/m^2$, the density of an unexposed part markedly increases to occasionally cause no commercial viability.

In the present invention, a matting agent is preferably incorporated into the photosensitive layer side. In order to minimize the image abrasion after thermal development, the matting agent is provided on the surface of a photosensitive material and the matting agent is preferably incorporated in an amount of 0.5 to 30 percent in weight ratio with respect to the total binder in the emulsion layer side. Further, when a non-photosensitive layer is provided opposite to a photosensitive layer, with a support between, a matting agent is preferably incorporated into at least a layer provided on said non-photosensitive layer side. In order to improve a slipping property of the thermally developable photosensitive material and to prevent a fingerprint adhesion of the thermally developable photosensitive material, said matting agent is preferably incorporated into the surface of the thermally developable photosensitive material. Said matting agent is preferably incorporated in an amount of 0.5 to 40 percent in weight ratio with respect to the total binder in the non-photosensitive layer provided opposite to the photosensitive layer.

Materials of the matting agents employed in the present invention may be either organic substances or inorganic substances. Regarding inorganic substances, for example, those can be employed as matting agents, which are silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc. Regarding organic substances, as organic matting agents those can be employed which are starch described in U.S. Pat. No. 2,322,037, etc.; starch derivatives described in Belgian Patent No. 625,451, U.K. Patent No. 981,198, etc.; polyvinyl alcohols described in Japanese Patent Examined Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The shape of the matting agent may be crystalline or amorphous. However, a crystalline and spherical shape is preferably employed. The size of a matting agent is expressed in the diameter of a sphere which has the same volume as the matting agent.

The matting agent employed in the present invention preferably has an average particle diameter of 0.5 to 10 $\mu$m, and more preferably of 1.0 to 8.0 $\mu$m. Furthermore, the variation coefficient of the size distribution is preferably not more than 50 percent, is more preferably not more than 40 percent, and is most preferably not more than 30 percent.

The variation coefficient of the size distribution as described herein is a value represented by the formula described below.

$$(\text{Standard deviation of grain diameter})/(\text{average grain diameter}) \times 100$$

The matting agent according to the present invention can be incorporated into arbitrary construction layers. In order to accomplish the object of the present invention, the matting agent is preferably incorporated into component layers other than the photosensitive layer, and is more preferably incorporated into the farthest layer from the support surface.

Additional methods of the matting agent according to the present invention include those in which a matting agent is previously dispersed into a coating composition and is then coated, and prior to the completion of drying, a matting agent is sprayed. When a plurality of matting agents are added, both methods may be employed in combination.

The thermally developable photosensitive material according to the invention comprises a support having thereon at least one photosensitive layer, and the photosensitive layer may only be formed on the support. Further, at least one non-photosensitive layer is preferably formed on the photosensitive layer. In order to control the amount or wavelength distribution of light transmitted through the photosensitive layer, a filter layer may be provided on the same side as the photosensitive layer, and/or an antihalation layer, that is, a backing layer on the opposite side. Dyes or pigments may also be incorporated into the photosensitive layer. As the usable dyes, those which can absorb aimed wavelength in desired wavelength region can be used, preferred are compounds described in JP-A Nos. 59-6481, 59-182436, U.S. Pat. Nos. 4,271,263, 4,594,312, European Patent Publication Nos. 533,008, 652,473, JP-A Nos. 2-216140, 4-348339, 7-191432, 7-301890.

Furthermore, these non-photosensitive layers may contain the above-mentioned binder, a matting agent and a lubricant such as a polysiloxane compound, a wax and a liquid paraffin.

The photosensitive layer may be composed of a plurality of layers. Furthermore, for gradation adjustment, in terms of sensitivity, layers may be constituted in such a manner as a fast layer/slow layer or a slow layer/fast layer.

The thermally developable photosensitive material, to which the present invention is applied, is subjected to formation of photographic images employing thermal development processing and preferably comprises a reducible silver source (organic silver salt), silver halide with an catalytically active amount, a hydrazine derivative, a reducing agent and, if desired, an image color control agent, to adjust silver tone, which are generally dispersed into a (organic) binder matrix. The thermally developable photosensitive material, to which the present invention is applied, is stable at normal temperatures and is developed, after exposure, when heated to high temperatures (for example, between 80 and 140° C.). Upon heating, silver is formed through an oxidation-reduction reaction between the organic silver salt (functioning as an oxidizing agent) and the reducing agent. This oxidation-reduction reaction is accelerated by the catalytic action of a latent image formed in the silver halide through exposure. Silver formed by the reaction with the organic silver salt in an exposed area yields a black image, which contrasts with an unexposed area to form an image. This reaction process proceeds without the further supply of a processing solution such as water, etc. from outside.

Image color control agents are preferably incorporated into the thermally developable photosensitive material to which the present invention is applied. Examples of suitable image color control agents are disclosed in RD Item 17029, and include the following;

imides (for example, phthalimide), cyclic imides, pyrazoline-5-ones, and quinazolinon (for example, succinimide, 3-phenyl-2-pyrazoline-5-one, 1-phenylurazole, quinazoline and 2,4-thiazolidione); naphthalimides (for example, N-hydroxy-1,8-naphthalimide); cobalt complexes (for example, cobalt hexaminetrifluoroacetate); mercaptans (for example, 3-mercapto-1,2,4-triazole); N-(aminomethyl) aryldicarboxyimides [for example, N-(dimethylaminomethyl)phthalimide]; blocked pyrazoles, isothiuronium derivatives and combinations of certain types of light-bleaching agents [for example, combination of N,N'-hexamethylene(1-carbamoyl-3,5 -dimethylpyrazole), 1,8-(3,6-dioxaoctane)bis(isothiuroniumtrifluoroacetate), and 2-(tribromomethylsulfonyl)benzothiazole]; merocyanine dyes [for example, 3-ethyl-5-((3-etyl-2-benzothiazolinylidene(benzothiazolinylidene))-1-methylethylidene-2-thio-2,4-oxazolidinedione]; phthalazinone, phthalazinone derivatives or metal salts thereof [for example, 4-(1-naphthyl)phthalazinone, 6-chlorophthalazinone, 5,7-dimethylphthalazinone, and 2,3-dihydro-1,4-phthalazinedione]; combinations of phthalazinone and sulfinic acid derivatives (for example, 6-chlorophthalazinone+benzenesulfinic acid sodium or 8-methylphthalazinone+p-trisulfonic acid sodium); combinations of phthalazine+phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, nartoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H,4H-2,3a,5,6a-tatraazapentalene). Preferred image color control agents include phthalazone or phthalazine.

In the present invention, to restrain or accelerate development for the purpose of controlling the development, to enhance the spectral sensitive efficiency, and to enhance the reservation stability before and after the development, a mercapto compound, a disulfide compound and a thione compound can be incorporated in the photosensitive material.

In cases where the mercapto compound is used in the present invention, any compound having a mercapto group can be used, but preferred compounds are represented by the following formulas, Ar—SM and Ar—S—S—Ar.

In the above-mentioned formulas, M represents a hydrogen atom or an alkaline metal atom, Ar represents an aromatic ring compound or a condensed aromatic ring compound having at least a nitrogen, sulfur, oxygen, selenium or tellurium. Preferable heteroaromatic ring compounds include benzimidazole, naphthoimidazole, benzothiazole, naphthothiazole, benzoxazole, naphthooxazole, benzoselenazole, benzotellurazole, imidazole, oxazole, pyrazole, triazole, thiadiazole, tetrazole, triazine, pyrimidine, pyridazine, pyrazine, pyridine, purine, quinoline or quinazoline. These heteroaromatic ring compounds may contain a substituent selected from a halogen atom (e.g., Br and Cl), a hydroxy group, an amino group, a carboxy group, an alkyl group (e.g., alkyl group having at least a carbon atom, preferably 1 to 4 carbon atoms) and an alkoxy group (e.g., alkoxy group having at least a carbon atom, preferably 1 to 4 carbon atoms). Examples of mercapto-substituted heteroaromatic ring compounds include 2-mercaptobenzimidazole, 2-mercaptobenzoxazole, 2-mercaptobenzothiazole, 2-mercapto-5-methylbenzothiazole, 3-mercapto-1,2,4-triazole, 2-mercaptoquinoline, 8-mercaptopurine, 2,3,5,6-tetrachloro-4-pyridinethiol, 4-hydroxy-2-mercaptopyrimidine and 2-mercapto-4-phenyloxazole, but the exemplified compounds according to the present invention are not limited thereto.

Antifoggants may be incorporated into the thermally developable photosensitive material to which the present invention is applied. The substance which is known as the most effective antifoggant is a mercury ion. The incorporation of mercury compounds as the antifoggant into photosensitive materials is disclosed, for example, in U.S. Pat. No. 3,589,903. However, mercury compounds are not environmentally preferred. As mercury-free antifoggants, preferred are those antifoggants as disclosed in U.S. Pat. Nos. 4,546,075 and 4,452,885, and JP-A No. 59-57234.

Particularly preferred mercury-free antifoggants are heterocyclic compounds having at least one substituent, represented by —C(X1)(X2)(X3) (wherein X1 and X2 each represent halogen, and X3 represents hydrogen or halogen), as disclosed in U.S. Pat. Nos. 3,874,946 and 4,756,999. As examples of suitable antifoggants, employed preferably are compounds and the like described in paragraph numbers [0030] through [0036] of JP-A No. 9-288328. Another examples of suitable antifoggants, employed preferably are compounds and the like described in paragraph numbers [0062] and [0063]. Furthermore, more suitable antifoggants are disclosed in U.S. Pat. No. 5,028,523, and U.K. Patent Application Nos. 92221383. No. 4, 9300147. No. 7, and 9311790. No. 1.

In the thermally developable photosensitive material to which the present invention is applied, employed can be sensitizing dyes described, for example, in JP-A Nos. 63-159841, 60-140335, 63-231437, 63-259651, 63-304242, and 63-15245; U.S. Pat. Nos. 4,639,414, 4,740,455, 4,741,966, 4,751,175, and 4,835,096. Useful sensitizing dyes employed in the present invention are described, for example, in publications described in or cited in RD Items 17643, Section IV-A (page 23, December 1978), 1831, Section X (page 437, August 1978). Particularly, selected can advantageously be sensitizing dyes having the spectral sensitivity suitable for spectral characteristics of light sources of various types of scanners. For example, compounds are preferably employed which are described in JP-A Nos. 9-34078, 9-54409, and 9-80679.

Various kinds of additives can be incorporated into a photosensitive layer, a non-photosensitive layer or other component layers. Except for the compounds mentioned above, surface active agents, antioxidants, stabilizers, plasticizers, UV (ultra violet rays) absorbers, covering aids, etc. may be employed in the thermally developable photosensitive material according to the present invention. These additives along with the above-mentioned additives are described in RD Item 17029 (on pages 9 through 15, June, 1978) and can be employed.

Of these, as preferred supports, preferably employed are plastic films [for example, polyethylene terephthalate (PET), polycarbonate, polyimide, nylon, cellulose triacetate, polyethylene naphthalate]. The thickness of the support is between about 50 and about 300 μm, and is preferably between 70 and 180 μm. Furthermore, thermally processed plastic supports may be employed. As acceptable plastics, those described above are listed. The thermal processing of the support, as described herein, is that after film casting and prior to the photosensitive layer coating, these supports are heated to a temperature at least 30° C. higher than the glass transition point, preferably by at least 35° C. and more preferably by at least 40° C. However, when the supports are heated at a temperature higher than the melting point, no advantages of the present invention are obtained.

As the base casting method of the support and subbing production method which are associated with the present invention, any of those known in the art can be employed. However, those methods described in paragraphs [0030] through [0070] of JP-A No. 9-50094 are preferably employed.

In the present invention, in order to improve an electrification property of the thermally developable photosensitive material, electrically conductive compound such as a metal oxide and/or an electrically conductive polymer can be incorporated into a photographic component layer. These compounds can be incorporated into any of the photographic component layer. However, these compound may preferably be incorporated into a sublayer, a backing layer, and a layer between a photosensitive layer and a sublayer. The electrically conductive compounds preferably used in the present invention are described in U.S. Pat. No. 5,244,773, on columns 14 through 20.

When the present inventive thermally developable material is applied to a printing material, hydrazine compound is preferably incorporated in said thermally developable material, and is more preferanly in said thermally developable material. Preferable examples of the hydrazine compound include those described in Research Disclosure Item 23515 (November, 1983, Page 346) and other references recited therein such as U.S. Pat. Nos. 4,080,207, 4,269,929, 4,276,364, 41278,748, 4,385,108, 4,459,347, 4,478,928, 41560,638, 4,686,167, 4,912,016, 4,988,604, 4,994,365, 5,041,355 and 5,104,769, BP 2,011,1391B, EP 217,310, 301,799 and 356,898, JP-A Nos. 60-179734, 61-170733, 61-270744, 62-178246, 62-270948, 63-29751, 63-32538, 63-104047, 63-121838, 63-129337, 63-223744, 63-234244, 63-234245, 63-234246, 63-294552, 63-306438, 64-10233, 1-90439, 1-100530, 1-105941, 1-105943, 1-276128, 1-280747, 1-283548, 1-283549, 1-285940, 2-2541, 2-77057, 2-139538, 2-196234, 2-196235, 2-198440, 2-198441, 2-198442, 2-220042, 2-221953, 2-221954, 2-285342, 2-285343, 2-289843, 2-302750, 2-304550, 3-37642, 3-54549, 3-125134, 3-184039, 3-240036, 3-240037, 3-259240, 3-280038, 3-282536, 4-51143, 4-56842, 4-84134, 2-230233, 4-96053, 4-216544, 5-45761, 5-45762, 5-45763, 5-45764, 5-45765, 6-289524 and 9-160164. In addition thereto, compounds described in (Chemical 1), concretely, those described at pages 3 and 4 in Japanese Patent Examined Publication No. 6-77138, those represented by the Formula (1), concretely, compounds 1–38 described at pages 8 to 18 of Japanese Patent Examined Publication No. 6-93082, those represented by the Formulas (4), (5) and (6), concretely, compounds 4-1 to 4-10 described at pages 25 and 26, those represented by the Formulas (4), (5) and (6), concretely, compounds 5-1 to 5-42 described at pages 28 to 36 and those represented by the Formulas (4), (5) and (6), concretely, compounds 6-1 to 6-7 described at pages 39 and 40 of JP-A No. 6-23049, those represented by the Formulas (1) and (2), concretely, compounds (1-1) to (1-17) and (2-1) described at pages 5 to 7 of JP-A No. 6-289520, those described in (Chemical 2) and (Chemical 3), concretely, compounds described at pages 6 to 19 of JP-A No. 6-313936, those described in (Chemical 1), concretely, compounds described at pages 3 to 5 of JP-A No. 6-313951, those represented by the Formulas (1), concretely, compounds 1-1 to 1-38 described in JP-A No. 7-5610, those represented by the Formula (11), concretely, compounds 11-1 to 11-102 described at pages 10 to 27 in JP-A No. 7-77783, and those represented by the Formulas (H) and (Ha), concretely, compounds H-1 to H-44 described at pages 8 to 15 in JP-A No. 7-104426.

More concretely, hydrazine derivatives represented by the formula (Z) may be employed.

Formula (Z)

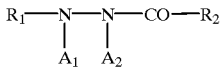

In the formula Z, R1 represents an aliphatic, aromatic or heterocyclic group, R2 represents an alkyl, aralkyl or aryl group, $A_1$ and $A_2$ each represents a hydrogen atom, alkylsulfonyl, aryl sulfonyl or acyl group, provided that both of $A_1$ and $A_2$ are hydrogen atom or one of the $A_1$ and $A_2$ is a hydrogen atom and the other is alkylsulfonyl, aryl sulfonyl or acyl group.

Exposure to the thermally developable photosensitive material of the present invention is preferably carried out using an Ar ion laser (488 nm), a He—Ne laser (633 nm), a red color semiconductor laser (670 nm), an infrared semiconductor laser (760 nm, 780 nm and 820 nm), etc. The infrared semiconductor laser is preferably employed in view of high power, transparency of the photosensitive material or so.

The exposure is preferably conducted by laser scanning exposure. In this occasion it is preferable to employ an exposing apparatus that the angle formed between the surface of the photosensitive material and laser light is not substantially perpendicular during exposure. The angle is preferably 55–88°, more preferably 60–86°, further preferably 65–84°, and most preferably 70–82°.

The exposure is preferably conducted by laser scanning exposure. In this occasion it is preferable to employ an exposing apparatus that the angle formed between the surface of the photosensitive material and laser light is not substantially perpendicular during exposure. The angle is preferably 55–88°, more preferably 60–86°, further preferably 65–84°, and most preferably 70–82°.

Spot diameter of the laser beam when scanning on the photosensitive material is preferably not more than 200 μm, and is more preferably not more than 100 μm. The smaller spot diameter is preferable because of reducing the angle difference from perpendicular point of angle of incidence.

The lower limit of the spot diameter of the laser beam is about 10 μm. By employing such a laser scanning exposure, image deterioration such as mottle of interference stripes caused by reflecting light when exposed by laser scanning can be reduced.

It is also preferable to employ an laser scanning exposure apparatus which emit longitudinal multiple mode scanning laser light. In this occasion image deterioration such as mottle of interference stripes can be reduced in comparison with longitudinal single mode laser light.

To make the light longitudinally multiple, a method is employed such as synthesizing waves, employing returning light, superposing high frequency wave. The longitudinally multiple light means that the exposure wave length is not simple, and has distribution of wavelength of not less than 5 nm, preferably 10 nm. The upper limit of the distribution of wavelength is usually 60 nm, for example.

EXAMPLES

The present invention is explained with reference to specific examples below. However, the present invention is not: limited to these examples.

Example 1

[Preparation of a thermally developable photosensitive material]

<Preparation of a photographic subbed PET support>

Commercially available biaxially stretched thermally fixed 175 μm PET film colored in blue was subjected to corona discharging treatment of 8 w/m$^2$ minute on both sides. Onto the surface of one side, the subbing coating composition a-1 described below was applied and dried so as to form a dry thickness of 0.8 μm and the resultant coating was designated subbing layer A-1. Furthermore, onto the opposite side surface, the antistatic treatment subbing coating composition b-1 described below was applied, so as to form a dry thickness of 0.8 μm, and the resultant coating was designated antistatic treatment subbing layer B-1.

(Subbing coating composition a-1)

| | |
|---|---|
| Latex composition (solid portion of 30 percent of a copolymer composed of butyl acrylate (30 weight percent), t-butyl acrylate (20 weight percent), styrene (25 weight percent), and 2-hydroxyethyl acrylate (25 weight percent) | 270 g |
| (C-1) | 0.6 g |
| Hexamethylene-1,6-bis(ethyleneurea) | 0.8 g |
| Water to make | 1 liter |

(Antistatic subbing coating composition b-1)

| | |
|---|---|
| Latex composition (solid portion of 30 percent of a copolymer composed of butyl acrylate (40 weight percent), styrene (20 weight percent), and glycidyl acrylate (40 weight percent) | 270 g |
| (C-1) | 0.6 g |
| Hexamethylene-1,6-bis(ethyleneurea) | 0.8 g |
| Water to make | 1 liter |

Subsequently, the surfaces of subbing layers A-1 and B-1 were subjected to corona discharging of 8 w/m$^2$·minute, and onto the subbing layer A-1, the subbing upper layer coating composition a-2 described below was coated to form subbing layer A-2 so as to obtain a dried thickness of 0.1 μm, and onto the subbing layer B-1, the subbing upper layer coating composition b-2 described below was coated to form subbing upper layer B-2 exhibiting antistatic function so as to obtain a dried thickness of 0.8 μm.

(Subbing upper layer coating composition a-2)

| | |
|---|---|
| Gelatin | weight to make 0.4 g/m$^2$ |
| (C-1) | 0.2 g |
| (C-2) | 0.2 g |
| (C-3) | 0.1 g |
| Silica particles (average diameter of 3 μm) | 0.1 g |
| Water to make | 1 liter |

(Subbing upper layer coating composition b-2)

| | |
|---|---|
| (C-4) | 60 g |
| Latex composition comprising (C-5) as a component (solid portion of 20 percent) | 80 g |
| Ammonium sulfate | 0.5 g |
| (C-6) | 12 g |
| Polyethylene glycol (weight average molecular weight of 600) | 6 g |
| Water to make | 1 liter |

(C-1)

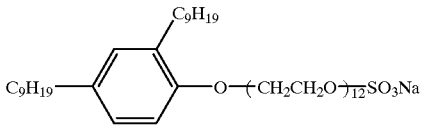

(C-2)

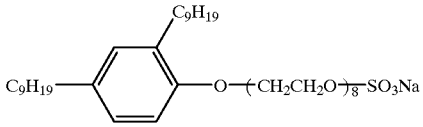

(C-3)

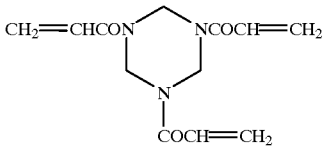

(C-4)

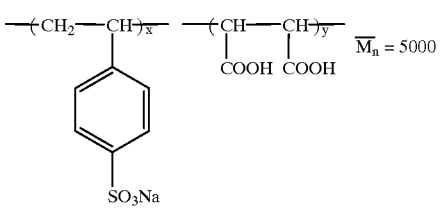

($\overline{Mn}$ is number average molecular weight)
x:y = 75:25(weight ratio)

-continued (C-5)

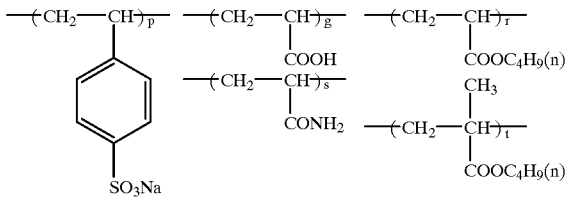

p:q:r:s:t = 40:5:10:5:40(Weight ratio)

(C-6)

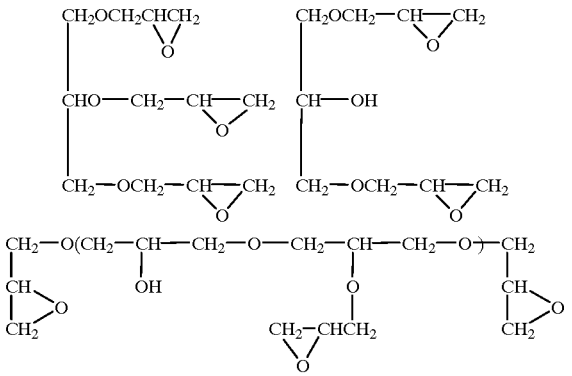

Mixture of three compounds above (Thermal treatment of support)

In the subbing and drying process for the above-mentioned subbed support, said support was heated to 140° C. and was then cooled gradually.

<Preparation of silver halide emulsion A>

In 900 ml of water, 7.5 g of inert gelatin and 10 mg of potassium bromide were dissolved. After adjusting the temperature to 35° C. and the pH to 3.0, 370 ml of an aqueous solution containing 74 g of silver nitrate, an aqueous solution containing potassium bromide and potassium iodide in a mole ratio of 98/2, $1\times10^{-6}$ mole of $Ir(NO)Cl_6$ salt per mole of silver, and $1\times10^{-6}$ mole of rhodium chloride salt per mole of silver were added employing a controlled double-jet method while maintaining the pAg at 7.7. The thus obtained aqueous solution was subjected to reduction sensitization while maintaining the pH at 8.7 and the pAg at 6.5. Subsequently, 4-hydroxy-6-methyl-1,3,3a,7-tetraazaindene was added and the pH was adjusted to 5 using NaOH. Thus obtained were cubic silver iodobromide grains having an average grain size of 0.06 μm, a monodispersibility of 10 percent, a projection diameter area variation coefficient of 8 percent, and a [100] plane ratio of 87 percent. The resulting emulsion was subjected to desalting through coagulation precipitation employing coagulant. After that, 0.1 g of phenoxyethanol was added, and the pH and pAg were adjusted to 5.9 and 7.5 respectively, to obtain a silver halide emulsion. Thus, silver halide emulsion A was obtained.

<Preparation of sodium behenate solution>

32.4 g of behenic acid, 9.9 g of arachidinic acid and 5.6 g of stearic acid were dissolved in 945 ml of deionized water at 90° C. To the thus obtained solution was added 98 ml of 1.5 M of sodium hydroxide aqueous solution while stirred at high speed. Subsequently, added to the solution obtained above was 0.93 ml of concentrated nitric acid, and after which the solution was cooled to 55° C. and stirred for 30 min. so as to obtain said sodium behenate solution.

<Preparation of a preformed emulsion derived from silver behenate and the silver halide emulsion A>

To the sodium behenate solution obtained above was added 15.1 g of the silver halide emulsion A cited above, after which the pH of the thus obtained solution was adjusted to 8.1, employing sodium hydroxide aqueous solution, and to the thus obtained solution was slowly added 147 ml of 1 M of nitric acid aqueous solution over a period of 7 min. After the thus obtained solution was stirred for 20 min.more, water-soluble salts were removed by employing an ultrafiltration method. Thus, obtained was silver behenate having an average particle size of 0.8 μm, and a monodispersibility of 8 percent. Dispersion blocks were then formed, after which water was removed from said dispersion blocks and further, water washing and water removal were carried out 6 more times, and after that said dispersion blocks were dried.

<Preparation of a photosensitive emulsion>

To the thus obtained preformed emulsion were slowly added 544 g of methyethyl ketone solution containing polyvinyl butyral (containing polyvinyl butyral in an amount of 17 wt %, average molecular weight of 3000), and 107 g of toluene, and the thus obtained solution was sufficiently blended and dispersed at 4000 psi. After being dispersed, the dispersed solution was observed with electromicrography. Particle size and thickness of 300 organic silver grains were measured, and as a result of said measurement, 205 grains were found to exhibit tabular organic silver grains having an AR of not less than 3. Further, the average particle size of said organic silver grains was 0.7 μm. After said dispersed solution was coated and dried, the same organic silver grains were observed, After said dispersed solution was coated and dried.

<Coating process>

(Coating a backing layer side)

A backing layer coating solution consisting of the following composition was applied on the subbing layer B-2 side employing an extrusion coater so as to obtain a wet thickness of 30 μm and the coating was then dried at 60° C. for 3 min.

(Backing layer coating solution 1)

| | |
|---|---|
| Cellulose acetatebutylate (10% methylethyl ketone solution) | 15 ml/m² |
| Dye-A | 7 mg/m² |
| Dye-B | 7 mg/m² |
| Matting agent (monodispersed silica having a monodispersibility of 15%, and an average particle size of 8 μm) | 30 mg/m² |

(Coating a photosensitive layer side)

A photosensitive layer coating solution consisting of the following composition, as well as a protective layer coating solution also shown in the following composition, to be coated on said photosensitive layer coating solution, were simultaneously applied employing an extrusion coater on the subbing layer A-2 side at a coating rate of 20 m/min. Simultaneously, the amount of coated silver was adjusted to 2.4 g/m². After coating, said coated photosensitive layer and protective layer were dried at 55° C. for 15 min.

(Photosensitive layer coating solution)

| | |
|---|---|
| Preformed emulsion | 240 g |
| Sensitizing dye-1 (0.1% methanol solution) | 1.7 ml |
| Pyridiniumbromideperbromide (6% methanol solution) | 3 ml |
| Potassium bromide (0.1% methanol solution) | 1.7 ml |
| Hexamethylene diisocyanate (10% methanol solution) | 3 ml |

-continued

| | |
|---|---|
| 2-(4-chlorobenzoyl)benzoic acid (12% methanol solution) | 9.2 ml |
| 2-mercaptobenzimidazole (1% methanol solution) | 11 ml |
| Tribromomethylsulfopyridine (5% methanol solution) | 17 ml |
| Developer-1 (20% methanol solution) | 29.5 ml |
| Phthaladine | 0.6 g |
| 4-methylphthalic acid | 0.25 g |
| Tetrachlorophthalic acid | 0.2 g |

Dye-A

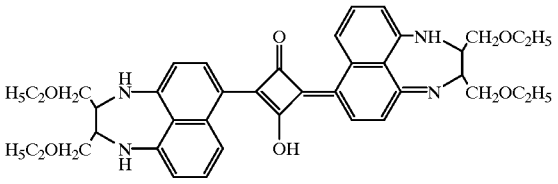

Dye-B

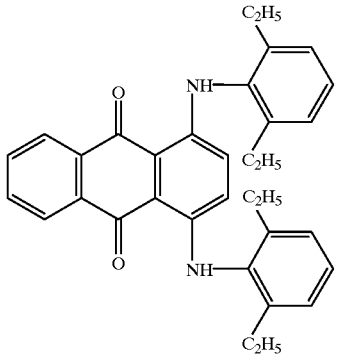

Sensitizing dye-1

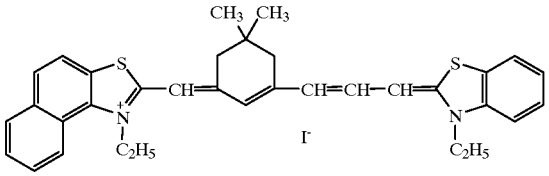

Developer-1

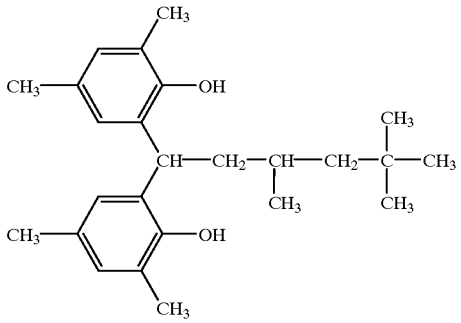

(Surface protective layer coating solution 1)

| | |
|---|---|
| Acetone | 5 ml/m$^2$ |
| Methylethyl ketone | 21 ml/m$^2$ |
| Cellulose acetatebutylate | 2.3 g/m$^2$ |

-continued

| | |
|---|---|
| Methanol | 7 ml/m$^2$ |
| Phthalazine | 250 mg/m$^2$ |
| $CH_2{=}CHSO_2CH_2CH_2OCH_2CH_2SO_2CH{=}CH_2$ | 35 mg/m$^2$ |
| Fluorine containing surfactant | weight as shown in Table 2 |

Further, employed as a matting agent, was combined usage of monodispersed silica particles having a monodispersibility of 10% and an average particle size of 3 $\mu$m, with spherical PMMA particles having an average particle size of 5 $\mu$m. At the same time, additional ratio of the silica particles and PMMA was varied so as to obtain a smooster value of each sample as shown in Table 2.

Thus, thermally developable photosensitive materials were obtained to provide Samples 101 through 111.

Unexposed samples were allowed to stand at 23° C. and 48% RH for 2 hours, and the smooster value on the surface of the photosensitive layer side of each sample was then measured under the same conditions as mentioned above (at 23° C. and 48% RH), employing SM-6B produced by Toei Electric Industry Co., Ltd.

(Exposure and developing process)

The thermally developable photosensitive material obtained above was cut into 5×15 cm sheets, and the thus obtained sheets were allowed to stand at 23° C. and 50% RH for 12 hours, after which 10 superposed sheets were put into a barrier bag which does not allow air and water to penetrate into it, which was then heated at 40° C. for 3 days. After that, the thus treated sheets were exposed through a wedge to a 810 nm laser light, employing a semiconductor sensitometer capable of generating a 810 nm laser light. The thus treated sheets were then subjected to thermal development at 110° C. for 15 sec., employing an automatic developing processor having a 20 cm radius cylindrical heat drum. At that time, exposure and development were carried out in a room regulated at 23° C. and 50% RH.

(Evaluation)

(Transferability test)

100 sheets were continuously subjected to thermal development, after which, transferability failures were noted.

(Density variation after thermal development)

The above-mentioned sheets of said thermally developable photosensitive material, which were exposed and thermally developed, were divided into two groups. The 1st group was placed in a thermostat under conditions of 50° C. and 60% RH for 5 days. A difference in density of 2.5 between before placing them in said thermostat and after placing them in the thermostat was measured employing a densitometer.

(Characteristic variation when varying thermal development conditions)

The thermally developable photosensitive material obtained above was exposed, and developed at 105° C. for 15 sec., employing an automatic developing processor. The difference between the sensitivity obtained at 105° C. for 15 sec. and the sensitivity obtained at 110° C. for 15 sec. is expressed as a percentage, based on the sensitivity obtained at 110° C. for 15 sec. Herein, the sensitivity is a relative value of the reciprocal of the amount of an exposure giving a density of 1.0.

Obtained results are shown in Table 2.

TABLE 2

| Sample No. | Fluorine containing surfactant Kind | Fluorine containing surfactant Additional amount | Smooster value on the surface of photosensitive layer side | Transfer-ability | Density variation when put in thermostat | Characteristic variation when thermal developing condition being varied | Remarks |
|---|---|---|---|---|---|---|---|
| 101 | None | — | 60 mmHg | 2 sheets | −0.5 | −25% | Comp. |
| 102 | None | — | 30 mmHg | 1 sheet | −0.5 | −20% | Comp. |
| 103 | FS-2 | 0.3 | 55 mmHg | 1 sheet | −0.5 | −15% | Comp. |
| 104 | FS-4 | 0.3 | 30 mmHg | None | −0.05 | −1.5% | Inv. |
| 105 | FS-5 | 0.3 | 30 mmHg | None | −0.05 | −1.5% | Inv. |
| 106 | FS-6 | 0.3 | 30 mmHg | None | −0.07 | −2.2% | Inv. |
| 107 | FS-9 | 0.3 | 30 mmHg | None | −0.07 | −2.3% | Inv. |
| 108 | FS-10 | 0.3 | 30 mmHg | None | −0.05 | −1.5% | Inv. |
| 109 | F-1 | 0.1 | 30 mmHg | None | −0.07 | −1.8% | Inv. |
| 110 | F-7 | 0.1 | 30 mmHg | None | −0.05 | −1.5% | Inv. |
| 111 | F-8 | 0.1 | 30 mmHg | None | −0.05 | −1.5% | Inv. |

Comp.: Comparison;
Inv.: Invention

As can be seen from Table 2, the present Inventive Samples 104 through 111 are exhibit more of the desired characteristics than the Comparative Samples 101 through 103, because in testing the inventive samples, no transferability was observed, and the density variation after thermal development and characteristic variation when the inventive samples are developed under varied thermal development condition, were minimal.

Example 2

Thermally developable photosensitive materials, being Samples 201 through 203 were obtained in the same ways as those employed in obtaining the thermally developable photosensitive materials in Example 1, except that the preparation conditions were changed to the following conditions.

(1) Employed as a backing layer coating solution applied on the backing layer side, was backing layer coating solution 2 consisting of the following components.

(Backing layer coating solution 2)

| | |
|---|---|
| Cellulose acetatebutylate (10% methylethyl ketone solution) | 15 ml/m$^2$ |
| Polyester (produced by Good Year Co., Ltd.) | 0.3 g/m$^2$ |
| Dye-C | 7 mg/m$^2$ |
| Fluorine containing surfactant | weight as shown in Table 2 |

(2) Employed as a surface protective coating solution applied on the photosensitive layer side, was surface protective layer coating solution used in Example 1.

(3) The coating rate for the photographic layer side was regulated to 30 m/min.

Backing layer prescription numbers and surface protective layer prescription numbers are shown in Table 3.

TABLE 3

| Sample No. | Backing layer pre-scription | Surface protective layer pre-scription | Trans-fera-bility | Density variation when put in thermo-stat | Characteristic variation when thermal developing condition is varied |
|---|---|---|---|---|---|
| 201 | 210 | 103 | None | −0.05 | −1.5% |
| 202 | 211 | 106 | None | −0.06 | −1.8% |
| 203 | 203 | 111 | None | −0.07 | −2.3% |

As can be seen from Table 3, the present Inventive Samples 201 through 203 are considered excellent, because no transportation failure is observed (transferability being excellent), and characteristic variations, when the inventive samples are developed under the varied thermal development condition, are very minute.

[Effect of the invention]

When a thermally developable photosensitive material is processed in an automatic processor, transportation failure can be prevented, and an image with less density variation after thermal developing process can be obtained, even when said image is stored over a long period of time, and further, an image with less variation of sensitivity and fogging can be obtained, independent of processing temperature.

Disclosed embodiment can be varied by a skilled person without departing from the spirit and scope of the invention.

What is claimed is:

1. A thermally developable material comprising a support, an image forming layer containing organic silver salts, and a component layer provided on the image forming layer side, wherein a smooster value on the surface of said image forming layer side of said thermally developable material is not more than 40 mm Hg, and said image forming layer or said component layer contains both a fluorine-containing surfactant and a reducing agent or a precursor of said reducing agent.

2. The thermally developable material of claim 1, wherein said image forming layer contains photosensitive silver halide grains, and said thermally developable material is a thermally developable photosensitive material.

3. The thermally developable material of claim 1, wherein a smooster value on the surface of said image forming layer side of said thermally developable material is between 0.1 mm Hg and 35 mm Hg.

4. The thermally developable material of claim 1, wherein said thermally developable material comprises a secondary component layer provided opposite to said image forming layer side, and a smooster value on the surface opposite to said image forming layer side of said image forming material is not less than 80 mm Hg, and said secondary component layer contains a fluorine containing surfactant.

5. The thermally developable material of claim 4, wherein said smooster value on the surface opposite to said image forming layer side of said image forming material is from 85 mm Hg to 400 mm Hg.

6. The thermally developable material of claim 1, wherein the content of tabular grains in whole organic silver grains contained in said image forming layer is not less than 60 mol %.

* * * * *